US008764616B2

(12) United States Patent
Cooper

(10) Patent No.: US 8,764,616 B2
(45) Date of Patent: Jul. 1, 2014

(54) SYSTEMS AND METHODS FOR A HILL TRAINING APPARATUS FOR A BICYCLE TRAINER

(71) Applicant: Pro-Climb, LLC, Seattle, WA (US)

(72) Inventor: Emily L. Cooper, Shoreline, WA (US)

(73) Assignee: Pro-Climb, LLC, Seattle, WA (US)

( * ) Notice: Subject to any disclaimer, the term of this patent is extended or adjusted under 35 U.S.C. 154(b) by 0 days.

(21) Appl. No.: 13/857,051

(22) Filed: Apr. 4, 2013

(65) Prior Publication Data

US 2013/0303339 A1 Nov. 14, 2013

Related U.S. Application Data

(63) Continuation of application No. 12/858,233, filed on Aug. 17, 2010, now Pat. No. 8,419,597.

(60) Provisional application No. 61/234,547, filed on Aug. 17, 2009.

(51) Int. Cl.
*A63B 69/16* (2006.01)

(52) U.S. Cl.
USPC ..... 482/61; 482/51; 482/57

(58) Field of Classification Search
USPC ..... 482/1–9, 51, 57, 61; 601/23, 36; 273/442; 434/61, 247
See application file for complete search history.

(56) References Cited

U.S. PATENT DOCUMENTS

| | | | | |
|---|---|---|---|---|
| 2,825,563 | A | 3/1958 | Lawton | |
| 3,024,023 | A | 3/1962 | Steller | |
| 3,578,800 | A | 5/1971 | DiNepi | 272/73 |
| 3,762,703 | A | 10/1973 | Gibbs | 272/73 |
| 4,477,072 | A | 10/1984 | DeCloux | 272/73 |
| 4,720,099 | A | 1/1988 | Carlson | 272/134 |
| 4,976,424 | A | 12/1990 | Sargeant et al. | 272/73 |
| 5,042,795 | A | 8/1991 | Bursik | 272/73 |
| RE34,479 | E | 12/1993 | Minoura | |
| 5,279,529 | A | 1/1994 | Eschenbach | 482/57 |
| 5,295,892 | A | 3/1994 | Felton | 446/224 |
| 5,356,356 | A | 10/1994 | Hildebrandt et al. | 482/62 |
| 5,549,527 | A | 8/1996 | Yu | 482/57 |
| 5,967,946 | A | 10/1999 | Beatty, Jr. | 482/61 |
| 6,217,487 | B1 | 4/2001 | Reinert | 482/54 |
| 6,659,101 | B2 * | 12/2003 | Berthon-Jones | 128/204.21 |
| 6,991,589 | B1 | 1/2006 | Patterson | 482/72 |
| 7,303,510 | B2 | 12/2007 | Gebhardt | 482/61 |
| 8,162,806 | B2 | 4/2012 | Hamilton | |
| 2002/0107114 | A1 | 8/2002 | Byrd, Jr. | 482/57 |
| 2005/0085354 | A1 | 4/2005 | Rice | 482/121 |
| 2006/0229163 | A1 | 10/2006 | Waters | 482/8 |
| 2006/0252607 | A1 | 11/2006 | Holloway | 482/62 |
| 2007/0010377 | A1 | 1/2007 | Wu | |
| 2007/0042868 | A1 | 2/2007 | Fisher et al. | 482/8 |
| 2008/0300113 | A1 | 12/2008 | Battiston | 482/51 |
| 2010/0096833 | A1 | 4/2010 | Gray | |

FOREIGN PATENT DOCUMENTS

| | | |
|---|---|---|
| FR | 2003598 | 11/1969 |

* cited by examiner

*Primary Examiner* — Glenn Richman
(74) *Attorney, Agent, or Firm* — Lee & Hayes, PLLC; C. Rachal Winger

(57) ABSTRACT

Described is a bicycle trainer with a hill training apparatus that enables bicyclists to simulate uphill riding (incline), downhill riding (decline), and hill resistance, or lack thereof. The hill training apparatus also provides for correct body positioning while riding uphill or downhill and with or without resistance. Riding on a trainer with correct body positioning provides for improved training.

32 Claims, 3 Drawing Sheets

SYSTEMS AND METHODS FOR A HILL TRAINING APPARATUS FOR A BICYCLE TRAINER

CROSS-REFERENCE TO RELATED APPLICATIONS

This application is a continuation of U.S. patent application Ser. No. 12/858,233 filed Aug. 17, 2010 which claims the benefit of U.S. Provisional Application No. 61/234,457 filed Aug. 17, 2009, both of which are incorporated herein by reference in their entirety.

FIELD OF THE DISCLOSURE

Disclosed herein are systems and methods for a hill training apparatus for a bicycle trainer. The systems and methods disclosed herein enable cyclists to simulate hill resistance, incline, decline, and body positioning while riding on a bicycle trainer for improved training purposes.

BACKGROUND OF THE DISCLOSURE

Cyclists use stationary bicycle trainers for training due to inclement weather, time constraints, and convenience and to achieve specific athletic objectives, such as performing controlled drills to improve their cycling performance. Most commonly cyclists attach their own bicycle to a portable trainer; however, occasionally they may use a stationary bicycle.

Most existing bicycle trainers consist of an apparatus that attaches to the rear wheel of the cyclist's bicycle in order to apply resistance which can vary throughout the workout. Additionally, most often, the front wheel sits in a simple rest, or the front wheel is removed and the front fork of the bicycle is mounted to a component of the trainer in order to support the front of the bicycle, which remains stationary during the workout. Stationary bicycles use the same method of applying resistance to the rear wheel to vary the difficulty of the workout.

Many indoor bicycle manufacturers provide compatible software programs that incorporate "virtual reality" effects where the user views a rider on a screen in front of him and the resistance applied to the bicycle on the trainer increases as the rider on the screen approaches a hill. Some of the programs also incorporate a steering option for the rider to simulate cornering while viewing the rider on the screen cornering right or left. These virtual reality programs use an increase in resistance applied to the rear wheel to simulate the increasing workload of an uphill effort and a decrease in resistance to simulate the decreasing workload of downhill effort.

U.S. Pat. No. 5,279,529 (the '529 patent) uses existing torque or resistance generators (load generators) to increase and decrease workload resistances in simulating incline and decline riding. It describes a pedal platform apparatus that simulates uphill or downhill riding, and focuses on assisting with cycling while in the standing cycling position. The '529 patent also provides for changing pedal positioning.

U.S. Pat. No. 4,976,424 (the '424 patent) allows for adjustable incline and decline of the front wheel achieved by manually positioning the fork mount for the purpose of creating a 'slight uphill' position for the comfort of the cyclist. The '424 patent simulates uphill and downhill resistance by adjusting the force applied via a resistance generator. To maintain constant resistance, the front fork support described in U.S. Pat. No. 4,976,424 moves in response to the cyclist's shifting weight to keep the back wheel in contact with the resistance rollers.

U.S. Patent Publication. No. 2002/20107114 (the '114 publication) allows for automatic inclination and declination of the front of the trainer to simulate uphill and downhill riding. To achieve inclination and declination of the front of the trainer the '114 publication describes utilizes a telescoping frame of a stationary bike which in turn raises and lowers the pedal height position.

U.S. Pat. No. 7,303,510 ("the '510 patent) allows for automatic inclination and declination of the front wheel of a bicycle using an elevator assembly and a wheel support assembly that is operatively coupled to the elevator assembly. To achieve proper declination of the front wheel to simulate downhill orientation, the '510 patent requires the use of elevation legs to support the bicycle some distance above the ground when in level orientation. In addition, the '510 patent provides for the wheel support assembly to be modified to attach to the bicycle's front fork through the use of a fixedly attached cylinder approximating a wheel axle. By fixedly attaching the bicycle's front fork to the wheel support assembly the horizontal movement of the fork in relation to the elevator assembly is removed. Without this horizontal movement, the ability to raise or lower the front fork of the bicycle is negated.

While these references provide some features to enhance bicycle trainers, there is still room for improvement in bicycle training devices. For example, none of these approaches allow for the simulation of hill training addressing resistance, incline, decline, and body positioning. In addition, none of these approaches allows for the simulation of decline hill training and body positioning without the need for additional components to raise the bicycle off the ground.

SUMMARY OF THE DISCLOSURE

Disclosed herein are systems and methods that allow the simulation of hill training addressing resistance, incline, decline, and body positioning. Embodiments disclosed herein allow a rider to simulate the biomechanical orientation characteristic of incline and decline outdoor hill cycling using a bicycle trainer while maintaining a fixed pedal position in relation to the bicycle frame. The bicycle trainer allows for automatic or manual incline and decline adjustment. Embodiments described herein can also allow for seated or standing training, incorporate extreme degrees of inclination and declination, allow for the cyclist to use their personal bicycles, and can be portable and require minimal effort to install, assemble, and use. Systems and methods disclosed herein achieve these benefits by raising or lowering the front of a bicycle using a rod's movement in a direction that does not match the directional movement of the front of the bicycle. The systems and methods can also be applied to the back of a bicycle.

Particularly, one embodiment disclosed herein includes an apparatus for a hill training stationary portable bicycle trainer comprising: a connecting rod; and a slider, slidably supported by a surface, wherein the connecting rod links the slider to a front fork and/or front wheel of a bicycle, wherein force applied to the slider causes the slider to slide along the surface altering the angle of the connecting rod and operating to raise or lower the front fork and/or front wheel of the bicycle.

Another embodiment includes an apparatus for a hill training stationary portable bicycle trainer comprising: a crank; a coupler; and a pivot, wherein the coupler links the crank to a front fork and/or front wheel of a bicycle through the pivot, wherein when torque is applied to the crank it alters the angle of the pivot causing the front fork and/or front wheel of the bicycle to raise or lower.

Another embodiment includes an apparatus for a hill training stationary portable bicycle trainer comprising: a rod; a slider; and a pivot; wherein the slider operatively connects the rod to a front fork and/or front wheel of a bicycle and, wherein the rod is operatively connected to the pivot such that torque applied to the rod causes the rod to rotate about the pivot such that the slider raises or lowers thereby raising or lowering the front fork and/or front wheel of the bicycle.

Embodiments disclosed herein can further comprise a rear mounting apparatus attached to the rear hub of the bicycle such that substantially no translation of the hub occurs in the vertical or horizontal direction. In another embodiment, the rear mounting apparatus measures the angular velocity of the hub and/or a rear wheel of the bicycle. In another embodiment, the rear mounting apparatus measures a cyclist's cadence. In another embodiment, the rear mounting apparatus provides resistance to the hub and/or a rear wheel of the bicycle.

Embodiments disclosed herein also include methods. Particularly, one method includes a method of adjusting the elevation of the front or back end of a bicycle comprising adjusting a rod's movement in a plane wherein the rod and the front or back end of the bicycle are linked and wherein movement of the rod is not parallel to the movement of the front or back end of the bicycle. This method can be used with the apparatus embodiments disclosed herein.

DETAILED DESCRIPTION

Previous bicycle trainers provide some features to enhance the training they achieve. There is still room for improvement, however, in bicycle training devices. For example, previous approaches did not allow for the simulation of decline hill training and body positioning without the need for additional components to raise the bicycle off the ground.

The presently-disclosed systems and methods provide for the simulation of hill training addressing resistance, incline, decline, and body positioning. Embodiments disclosed herein allow a rider to simulate the biomechanical orientation characteristic of incline and decline outdoor hill cycling using a bicycle trainer while maintaining a fixed pedal position in relation to the bicycle frame. The bicycle trainer allows for automatic or manual incline and decline adjustment. Embodiments described herein can also allow for seated or standing training, incorporate extreme degrees of inclination and declination, allow for the cyclist to use their personal bicycles, and can be portable and require minimal effort to install, assemble, and use. Systems and methods disclosed herein achieve these benefits by raising or lowering the front of a bicycle using a rod's movement in a direction that does not match the directional movement of the front of the bicycle. Accordingly, no additional components are required to achieve the desired downhill positioning and the mechanisms to achieve this positioning do not interfere with the front of the bicycle. The following non-limiting and exemplary embodiments are provided.

Figure 1:
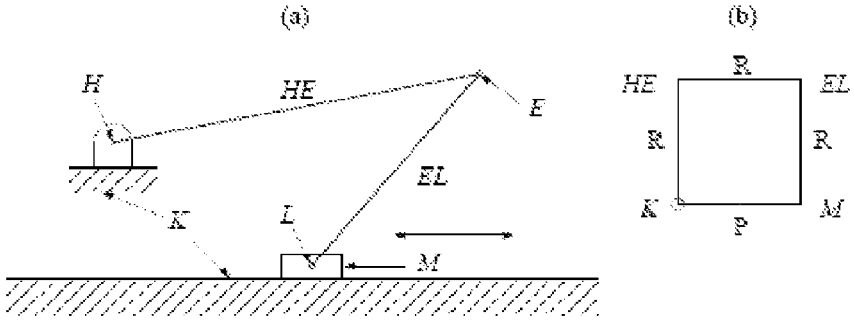
FIG. 1 depicts a side view of features of a hill training apparatus described and referred to herein as an R-R-R-P implementation or embodiment.

One embodiment of the systems and methods disclosed herein is depicted in FIG. 1(*a*) with the corresponding kinematic structure is shown in FIG. 1(*b*). In this embodiment, link 1 is the ground (K), link 2 is the bicycle frame (HE), link 3 is the connecting rod (EL), and link 4 is the slider (M). This embodiment has one degree of freedom. The orientation of the bicycle frame (HE) can be manipulated by applying a horizontal force to the slider (M). Such a force will cause the connecting rod (EL) to move and thus effect a change in the orientation of the bicycle frame (HE). Particularly, movement of the slider (M) towards the back of the bicycle lowers the front of the bicycle. Movement of the slider (M) towards the front of the bicycle raises the front of the bicycle. This movement is achieved because slider (M) is connected to sufficiently rigid connecting rod (EL). As can be seen, in this embodiment, no additional components are required to elevate the bicycle to achieve this downhill position and the mechanism to achieve it does not unduly limit the downhill angle that can be achieved. This embodiment can be referred to as an R-R-R-P implementation.

Figure 2:
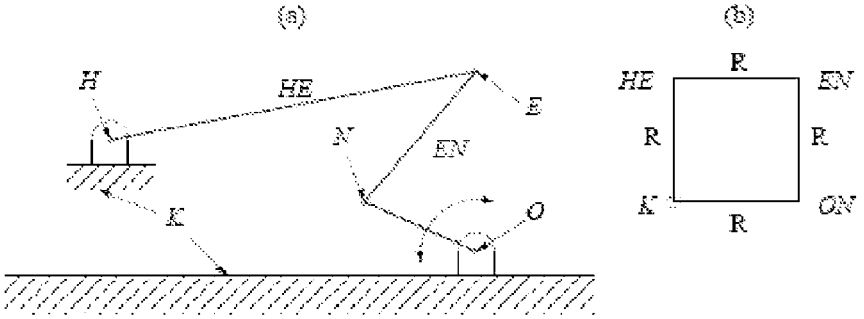
FIG. 2 depicts a side view of features of a hill training apparatus described and referred to herein as an R-R-R-R mechanism or embodiment.

Another embodiment, referred to as an R-R-R-R mechanism, is shown in FIG. 2(*a*) (schematic) and 2(*b*) (kinematic). FIG. 2 depicts a 'four-bar' (four link) mechanism. In this embodiment, the ground is link 1, the bicycle frame (HE) is link 2, the coupler (EN) is link 3, and the crank (O) is link 4. This mechanism also has one degree of freedom. One approach to manipulating the orientation of the bicycle frame is to control the angle of the crank (O). For example, a torque applied to the crank (O) will cause a change in the orientation of the bicycle frame (HE). In particular exemplary embodiments adjusting the crank (O) towards the front of the bicycle brings coupler (EN) forward raising the front of the bicycle, while adjusting the crank (O) towards the back of the bicycle brings coupler (EN) backwards, lowering the front of the bicycle. Again, in this embodiment, no additional components are required to elevate the bicycle to achieve this downhill position and the mechanism to achieve it does not unduly limit the downhill angle that can be achieved.

Figure 3:
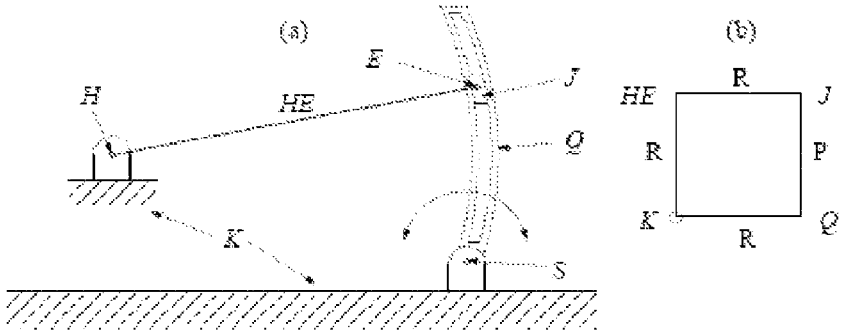
FIG. 3 depicts a side view of features of a hill training apparatus described and referred to herein as an R-R-RRP-R mechanism or embodiment.
Figure 4A:
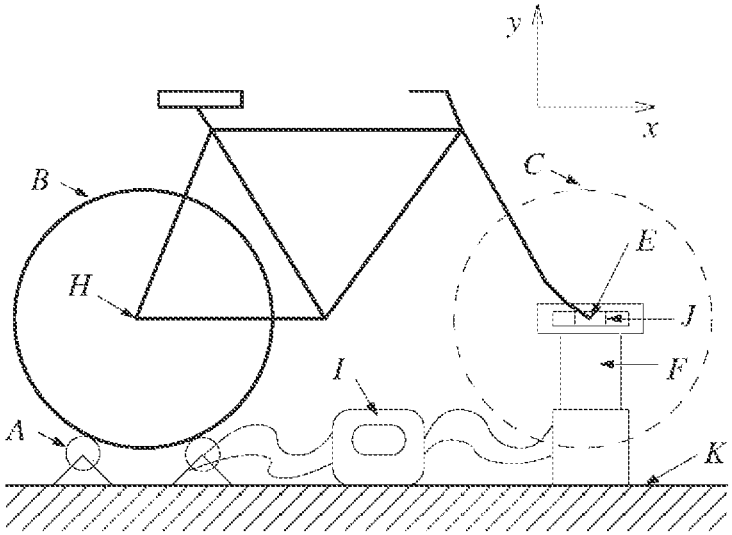
FIGS. 4A-4D depict a side view of a bicycle attached to a hill training apparatus described herein.
Figure 4B:
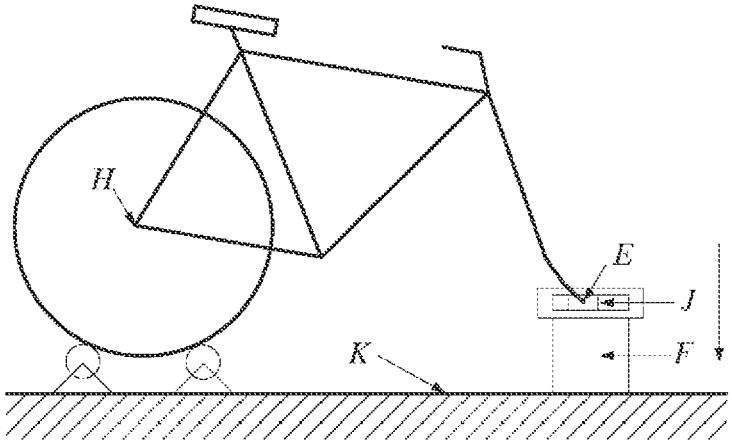
Figure 4C:
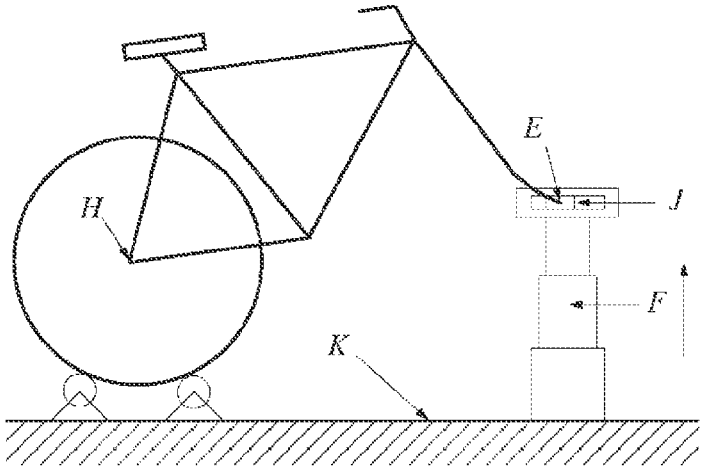
Figure 4D:
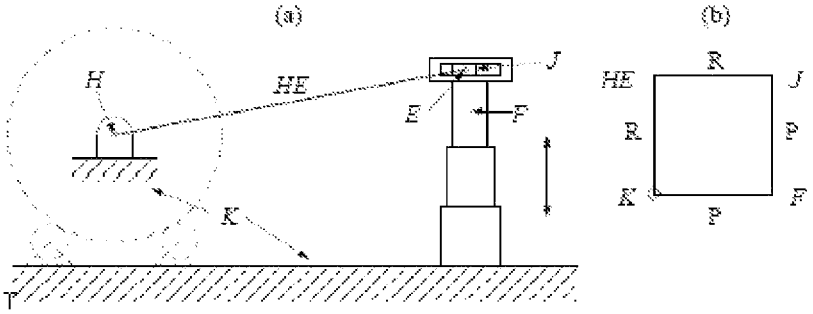

Yet another embodiment, referred to herein as the R-R-P-R mechanism, is shown in FIGS. 3(*a*) (schematic) and 3(*b*) (kinematic). In this embodiment, link 1 is the ground (K), link 2 is the bicycle frame (HE), link 3 is the slider (J), and the rod (Q) is link 4. This embodiment has one degree of freedom. The manipulation of the bicycle frame (HE) can be accomplished by applying a torque to the rod (Q) about the pivot (S). Such a torque will cause the rotation of the rod (Q) and as a result the orientation of the bicycle frame (HE) must change so as to satisfy the loop closure condition.

While the previous exemplary embodiments require no additional components to elevate the bicycle to achieve the described downhill positions and the mechanisms to achieve these positions do not unduly limit the downhill angle that can be achieved, it should be understood that the embodiments described above can also be used in combination with previously-used approaches. An example is depicted in FIG. 4(*a*)-(*d*). In this example, the entire hill training apparatus rests on the ground (K). The figure shows the bicycle in the level position (i.e., neither up hill nor down hill). In this schematic the bicycle's front wheel (C) is removed, and hence is represented by the dashed circle.

The bicycle's front fork (E) is attached to an apparatus (F) via slider (J). The apparatus (F) is used to raise and lower the front fork (E) of the bicycle so as to simulate cycling up or down a hill. FIG. 4(*b*) shows the bicycle trainer of FIG. 4(*a*) in the downhill position. To obtain this configuration the apparatus (F) translates downwards, (i.e. in the −y direction) and the slider (J) translates backwards, (i.e. in the −x direction). FIG. A(c) shows the bicycle trainer of FIG. 4(*a*) in an uphill position. To obtain this configuration the apparatus (F) translates upwards, (i.e. in the +y direction) and the slider (J) translates backwards, (i.e. in the −x direction).

The +/−y direction motion generated by the apparatus (F) can be realized using previously-known devices including, without limitation: telescoping hydraulic or pneumatic cylinders; direct drive linear translation motors; a rack and pinion system driven by a rotational motor; or a Scotch yoke mechanism. As described above, the apparatus (F), in conjunction with the slider (J), allows the bicycle frame to rotate about the hub (H). While this embodiment allows for inclination and declination of the bicycle to simulate the biomechanical orientation characteristic of outdoor hill cycling using a bicycle trainer, the kinematic behavior can be realized more effectively using the alternate kinematic structures above in FIGS. 1-3.

FIGS. 4(*a*)-(*d*) describe additional features that can also be used with the embodiments disclosed in FIGS. 1-3. For example, FIG. 4(*a*) depicts a rear mounting apparatus (A) attached to the rear wheel of the cyclist's bicycle (B). A computer control panel (I) is connected to the rear mounting apparatus (A) and to the apparatus (F). Notwithstanding FIG. 4, in certain embodiments, the computer control panel (I) can be mounted on the bicycle handle bar.

In some embodiments, the rear mounting apparatus (A) can attach to the hub (H) of the cyclist's bicycle. Embodiments disclosed herein can also be modified so that the rear wheel (B) and/or the hub (H) is raised and lowered by apparatus (F) or according to the embodiments depicted in FIGS. 1-3 above rather than the front wheel (C). Those of ordinary skill in the art understand these modifications and they are not discussed in detail herein.

As the cyclist pedals the back wheel (B) rotates about the hub (H). The rear mounting apparatus (A) can provide several functions including, without limitation: ensuring that the hub (H) does not translate in the horizontal direction (x), or the vertical direction (y), relative to the ground (K); measuring the angular velocity of the back wheel, which can be used to determine the effective translational speed of the cyclist; measuring the cadence of the cyclist; and providing resistance to the back wheel (B) and/or hub (H).

The computer control panel (I) can be used to perform various tasks, including, without limitation: sensing and recording the angular velocity of the back wheel (B); sensing and recording the cadence of the cyclist; computing the effective translational velocity of the cyclist; sensing and recording the height of apparatus (F); and regulating the height of apparatus (F) so as to put the cyclist in an uphill, level, or downhill orientation.

In addition, using the effective translational velocity of the cyclist, the computer control panel can be used to determine the instantaneous height of the apparatus (F) so as to simulate cycling on a specific hill.

To begin a kinematic analysis for a hill training apparatus as described herein, note that in all orientations of the bicycle the hub (H) does not translate significantly or at all. That is, the hub (H) does not substantially move in the horizontal or vertical direction relative to the ground (K). Hence, the hub (H) can be treated as a stationary point (affixed to the ground (K)). Moreover, the bicycle frame is assumed to be sufficiently rigid, thus the distance between the hub (H) and the fork (E) is functionally constant in all orientations of the bicycle in the hill training apparatus. Embodiments disclosed herein can be modified, however, such that the hub (H) translates to move vertically and/or horizontally relative to the ground (K). In such modified embodiments, the front fork (E) would not substantially translate and would therefore be treated as a stationary point.

FIG. 4(*d*)(*b*) is a kinematic representation of a hill training apparatus under the assumptions stated above. This is a four link mechanism that forms a closed kinematic chain. The links that make up the mechanism are as follows. Link 1 is the ground (K), link 2 is the bicycle frame, represented by HE, link 3 is the slider (J), and link 4 is the apparatus (F). Based on this diagram, one of ordinary skill in the art will note that links 1 and 2 are connected via a revolute (or turning) pair (R). See Fabien, B. C., *Analytical System Dynamics: Modeling and Simulation*, Springer, 2009:64-73). This is because link 2 (the bicycle frame (HE)) can rotate relative to the link 1 (the ground (K)) about the hub (H). Links 2 and 3 are connected by a revolute pair (R). This is because link 2 (the bicycle frame (HE)) can rotate relative to the slider (J) about the front fork (E). Links 3 and 4 are connected by a prismatic (or sliding) pair (P). This is because link 3 (the slider (J)) can only translate in the horizontal direction relative to link 4 (apparatus (F)). Finally, links 4 and 1 are connected by a prismatic pair (P). This is because link 4 (apparatus (F)) can only translate in the vertical direction relative to the ground (K). Thus, in this realization the hill training apparatus is called an R-R-P-P mechanism.

The mobility of this mechanism can be established using Gruebler's equation ([1], pp. 70). Specifically, the number of degrees of freedom (DOF) for this mechanism is given by $$DOF = \lambda(l - j - 1) + \sum_{i=1}^{j} f_i, \tag{1}$$

where λ=3 for motion in a plane, I is the number of links in the mechanism, j is the number of joints in the mechanism, and fi is the number of degrees of freedom allowed at the i-th joint. Therefore, the R-R-P-P mechanism shown in FIG. 4(*d*) has $$DOF=3(4-4-1)+4=1$$

That is, the mechanism has one degree of freedom. By regulating any one of the degrees of freedom at the joints the bicycle frame (HE) can be placed in an arbitrary orientation.

For example, the height of the apparatus (F) can be controlled to manipulate the orientation of the bicycle frame (HE). If apparatus (F) is a hydraulic cylinder, applying a force via the cylinder will cause the front fork (E) to be raised (or lowered).

Unless otherwise indicated, all numbers expressing numerical values and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods disclosed herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are disclosed herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically disclosed herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. An apparatus for a hill training stationary portable bicycle trainer comprising:

a connecting rod; and a slider, slidably supported by a surface, wherein the connecting rod links the slider to a rear fork and/or rear wheel of a bicycle, wherein force applied to the slider causes the slider to slide along the surface altering an angle of the connecting rod relative to the slider and operating to raise or lower the rear fork and/or rear wheel of the bicycle.

2. The apparatus of claim 1 further comprising a rear mounting apparatus attached to the rear hub of the bicycle.

3. The apparatus of claim 2 wherein the rear mounting apparatus measures the angular velocity of the hub and/or a rear wheel of the bicycle.

4. The apparatus of claim 2 wherein the rear mounting apparatus measures a cyclist's cadence.

5. The apparatus of claim 2 wherein the rear mounting apparatus provides resistance to the hub and/or a rear wheel of the bicycle.

6. The apparatus of claim 1 further comprising a front mounting apparatus attached to the front hub of the bicycle such that substantially no translation of the front hub occurs in the vertical or horizontal direction.

7. The apparatus of claim 2 further comprising a computer control panel connected to the rear mounting apparatus.

8. An apparatus for a hill training stationary portable bicycle trainer comprising:

a crank;

a coupler; and a pivot, wherein the coupler links the crank to a rear fork and/or rear wheel of a bicycle through the pivot, and when torque is applied to the crank it alters an angle of the pivot between the crank and the coupler, thereby causing the rear fork and/or rear wheel of the bicycle to raise or lower.

9. The apparatus of claim 8 further comprising a rear mounting apparatus attached to the rear hub of the bicycle.

10. The apparatus of claim 9 wherein the rear mounting apparatus measures the angular velocity of the hub and/or a rear wheel of the bicycle.

11. The apparatus of claim 9 wherein the rear mounting apparatus measures a cyclist's cadence.

12. The apparatus of claim 9 wherein the rear mounting apparatus provides resistance to the hub and/or a rear wheel of the bicycle.

13. The apparatus of claim 8 further comprising a mounting apparatus attached to the front hub of the bicycle such that substantially no translation of the hub occurs in the vertical or horizontal direction.

14. The apparatus of claim 9 further comprising a computer control panel connected to the mounting apparatus.

15. An apparatus for a hill training stationary portable bicycle trainer comprising:

a rod;

a slider; and a pivot;

wherein the slider operatively connects the rod to a rear fork and/or rear wheel of a bicycle and the rod is operatively connected to the pivot such that torque applied to the rod causes the rod to rotate about the pivot such that the slider is raised or lowered thereby raising or lowering the rear fork and/or rear wheel of the bicycle.

16. The apparatus of claim 15 further comprising a rear mounting apparatus attached to the rear hub of the bicycle.

17. The apparatus of claim 16 wherein the rear mounting apparatus measures the angular velocity of the hub and/or a rear wheel of the bicycle.

18. The apparatus of claim 16 wherein the rear mounting apparatus measures a cyclist's cadence.

19. The apparatus of claim 16 wherein the rear mounting apparatus provides resistance to the hub and/or a rear wheel of the bicycle.

20. A method of adjusting the elevation of the front or rear end of a bicycle comprising adjusting a rod's movement in a plane wherein the rod and the front or rear end of the bicycle are linked; the angle of the rod's movement relative to the front or rear end of the bicycle operates to raise or lower the front or rear end of the bicycle; and the movement of the rod is not parallel to the movement of the front or rear end of the bicycle.

21. The method of claim 20 further comprising measuring the angular velocity of the hub and/or a front or rear wheel of the bicycle.

22. The method of claim 20 further comprising measuring a cyclist's cadence.

23. The method of claim 20 further comprising providing resistance to the hub and/or a front or rear wheel of the bicycle.

24. The method of claim 21 further comprising determining the effective translational velocity of the cyclist.

25. The apparatus of claim 15 further comprising a mounting apparatus attached to the front hub of the bicycle such that substantially no translation of the hub occurs in the vertical or horizontal direction.

26. The apparatus of claim 16 further comprising a computer control panel connected to the mounting apparatus.

27. An apparatus for a hill training stationary portable bicycle trainer comprising:

a crank; and a coupler;

wherein the coupler links the crank to a front fork and/or front wheel of a bicycle, wherein when torque is applied to the crank it alters an angle of the coupler relative to the front fork of the bicycle which alters the orientation of the bicycle frame thereby causing the front fork and/or front wheel of the bicycle to raise or lower; or wherein the coupler links the crank to a rear fork and/or rear wheel of a bicycle, wherein when torque is applied to the crank it alters an angle of the coupler relative to the rear fork of the bicycle which alters the orientation of the bicycle frame thereby causing the rear fork and/or rear wheel of the bicycle to raise or lower.

28. The apparatus of claim 27 wherein the coupler is linked to: (a) the front fork and/or front wheel and a mounting apparatus is attached to a rear hub of the bicycle; or (b) the rear fork and/or rear wheel and a mounting apparatus is attached to a front hub such that substantially no translation of the front hub occurs in the vertical or horizontal direction.

29. The apparatus of claim 28 wherein the mounting apparatus measures the angular velocity of the front or rear hub, and/or the front or rear wheel of the bicycle.

30. The apparatus of claim 28 wherein the mounting apparatus measures a cyclist's cadence.

31. The apparatus of claim 28 wherein the mounting apparatus provides resistance to the front hub, rear hub, front wheel, and/or rear wheel of the bicycle.

32. The apparatus of claim 28 further comprising a computer control panel connected to the mounting apparatus.

* * * * *